US005284998A

United States Patent [19]

Lima et al.

[11] Patent Number: 5,284,998

[45] Date of Patent: Feb. 8, 1994

[54] DRUM AND PROCESS FOR HANDLING DRUM LINERS

[75] Inventors: William Lima, Monmouth Beach; Earl V. Lind, Brick; Philip D. Bartlett, Holmdel, all of N.J.

[73] Assignee: Russell-Stanley Corporation, Red Bank, N.J.

[21] Appl. No.: 54,694

[22] Filed: Apr. 29, 1993

Related U.S. Application Data

[63] Continuation of Ser. No. 655,757, Feb. 14, 1991, abandoned.

[51] Int. Cl.[5] ..... B09B 1/00

[52] U.S. Cl. ..... 588/252; 588/249; 405/128

[58] Field of Search ..... 405/128, 129; 588/249, 588/252, 259

[56] References Cited

U.S. PATENT DOCUMENTS

| | | | |
|---|---|---|---|
| H404 | 1/1988 | Sayles | 588/252 X |
| 3,167,210 | 1/1965 | Carney, Jr. . | |
| 3,215,307 | 11/1965 | Connell . | |
| 3,262,628 | 7/1966 | Heisler et al. . | |
| 3,409,201 | 11/1968 | Carpenter, Jr. . | |
| 4,564,469 | 1/1986 | Cochet et al. | 588/249 |
| 4,632,847 | 12/1986 | Lomasney et al. | 588/249 |
| 4,635,814 | 1/1987 | Jones . | |
| 4,712,711 | 12/1987 | Geering et al. . | |

FOREIGN PATENT DOCUMENTS

| | | |
|---|---|---|
| 0358053 | 3/1990 | European Pat. Off. . |
| 2135746 | 2/1972 | Fed. Rep. of Germany . |
| 2822768 | 11/1979 | Fed. Rep. of Germany . |
| 0018758 | 11/1980 | Fed. Rep. of Germany . |
| 3016541 | 11/1981 | Fed. Rep. of Germany . |
| 3034328 | 8/1988 | Fed. Rep. of Germany . |
| 648863 | 1/1951 | United Kingdom . |

*Primary Examiner*—Dennis L. Taylor
*Assistant Examiner*—J. Russell McBee
*Attorney, Agent, or Firm*—Hedman, Gibson & Costigan

[57] ABSTRACT

Drums liners and methods used in the handling of hazardous materials and liquids comprising the use of disposable drum liners having a fitting allowing communication with the interior of the liner for securing the liner to a conventional drum bung hole, said fitting to be used to evacuate and collapse the liner, and a reseal plug attached to the fitting to seal the collapsed liner, said reseal plug having means to accept a plunger. The lid of the drum is removed and the sealed liner is taken from the drum using the plunger attached to the reseal plug. The liner is then placed into a disposal drum made of the same material as the liner and compressed. Once the disposal drum contains a sufficient number of compressed liners, it is removed for incineration or other safe disposal.

10 Claims, 4 Drawing Sheets

DRUM AND PROCESS FOR HANDLING DRUM LINERS

This is a continuation of U.S. application Ser. No. 07/655,757, filed Feb. 14, 1991 and now abandoned.

FIELD OF THE INVENTION

This invention relates to drums for handling materials and liquids that are not to be exposed to the environment. More particularly, the invention relates to drums provided with impervious flexible removable liners and methods for ecologically disposing of the liners.

BACKGROUND OF THE INVENTION

Drums have been used to store and transport fluids for many years. Wooden barrels have been used for generations to store and transport a wide variety of liquids, e.g. water, wine, etc. Later, steel drums were developed to handle a greater variety of liquids. Hydrocarbons and other chemical products are typically transported in steel drums. More recently, polyethylene drums have been developed to handle hazardous chemical liquids.

With the increase in drum transportation of hazardous chemical liquids, liners resistant to the deleterious effects of hazardous chemicals have been developed for the interior of the drums.

Rigid liners for drums as illustrated by U.S. Pat. No. 4,712,711 have been used since the 1950s for distribution of hazardous liquids. However, they are difficult to remove from a drum when emptied and are not easily collapsible.

However, the toxicity and other hazardous effects of the liquids stored and transported in drums has required reconditioning of the drums prior to reuse. In effect, an entire industry exists to remove all trace of the contents of drums and safely dispose of the contents. In view of the hazardous nature of many of the liquids found in drums, the problem of disposing of the contents in an ecologically safe manner has arisen.

Flexible liners such as illustrated by U.S. Pat. Nos. 4,635,814; 3,409,201; 3,262,628; 3,215,307 and 3,167,210 have been developed and have promise in containing hazardous liquids to facilitate ecologically safe disposal of the liquids.

SUMMARY OF THE INVENTION

This invention is directed to using flexible drum liners in a safe reliable process for disposing of the liners without allowing the contents of the drum liners to contaminate the environment.

A further objective of the invention is to provide a drum with a liner adapted for safe withdrawal from the drum.

To this end, a conventional steel or polyethylene drum is provided with a flexible liner having a fitting hermetically secured thereto. The fitting of the flexible drum liner is adapted to be mounted in the bung hole of the drum. Detachment means and means to reseal the fitting are also provided after the drum has been emptied.

The process of the invention proceeds after the drum has been emptied by first evacuating any air and other gases from a spent liner to collapse the liner. The liner is then resealed by securing a reseal means (cap) to the fitting after the liner has been collapsed. A plunger having a head specially adapted to grip the reseal cap is attached to the reseal cap, the liner fitting is then released from the drum cover bung hole and the plunger is used to push the fitting and the collapsed liner to the bottom of the drum.

Thereafter, the top of the drum is removed, usually by a cutting operation and the flexible liner and fitting are removed from the drum and compacted into a safe disposal drum made of a plastic, such as polyethylene.

When a disposal drum has been filled with flexible liners, the disposal drum is transported to a safe site for ultimate disposal, usually by incineration.

DESCRIPTION OF THE DRAWINGS

The present invention will be better understood when considered with the accompanying drawings wherein.

DESCRIPTION OF THE PREFERRED EMBODIMENT

The present invention has application in all instances wherein drum reconditioning occurs. It applies to all drums capable of storing hazardous liquids such as corrosive or flammable liquids that must be safely handled to avoid ecological harm. However, the present invention will be described with reference to a conventional drum formed with a non-removable top head.

Figure 1:
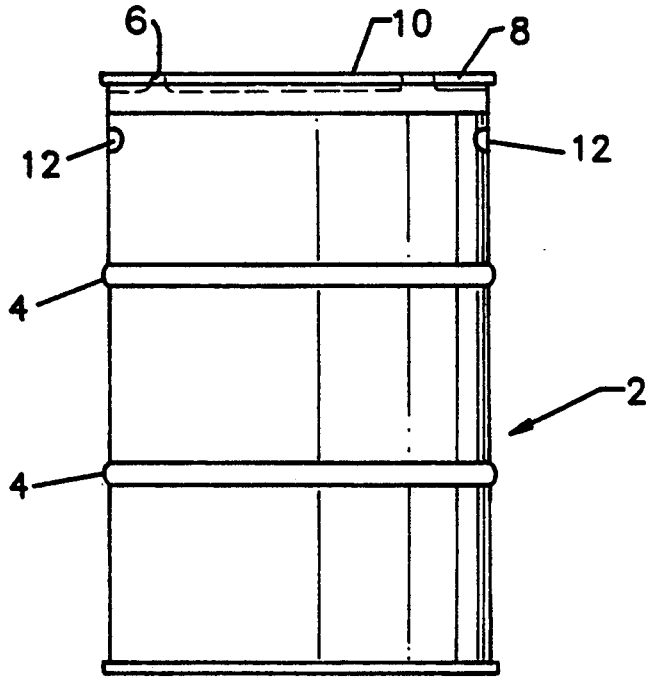
FIG. 1 is a sectional elevational view of a drum used in the process of the invention.
Figure 2:
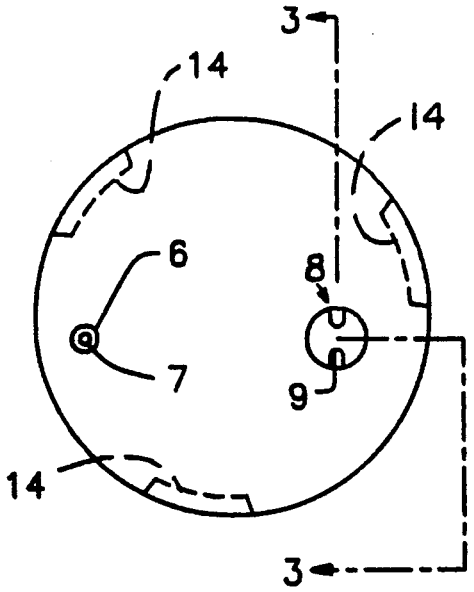
FIG. 2 is a top plan view of the drum of FIG. 1.

As best seen in FIG. 1, a steel fifty-five gallon drum (2) of conventional dimensions is shown. The drum (2) is provided with conventional rolling hoops (4), an opening (8) in the top head (10) and a three-quarter inch (¾) vent (6) with a snap-on seal. In addition, the drum (2) is provided with a plurality of at least three (3) essentially symmetrically arranged indentations (12) located on the drum body about two inches (2") below the top head (10). The indentations (12) form internal protrusions (14), best seen in FIG. 2, that extend about one half inch (½) into the interior of the drum (2).

Figure 3:
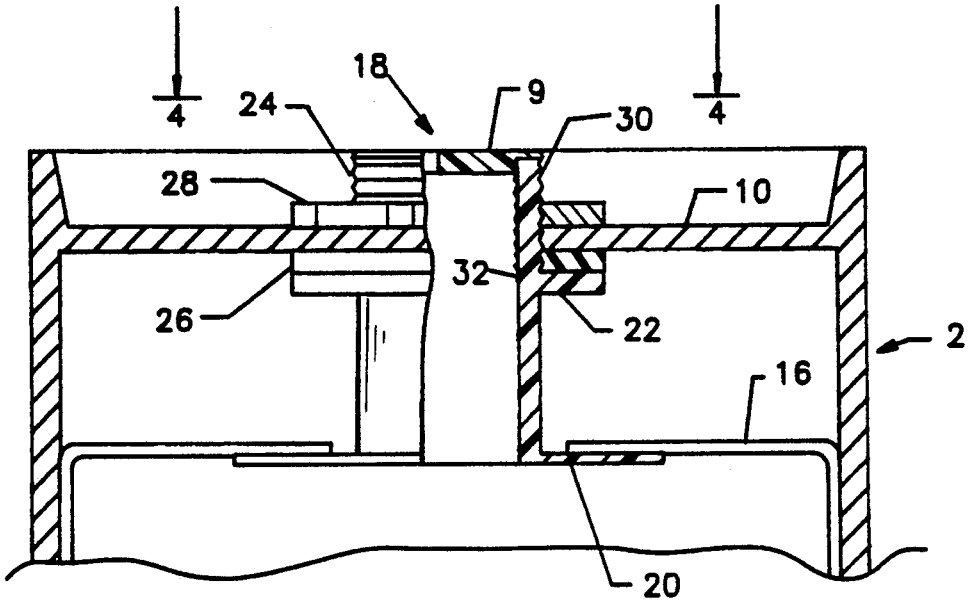
FIG. 3 is a sectional elevational view taken through lines 3—3 of FIG. 2.
Figure 4:
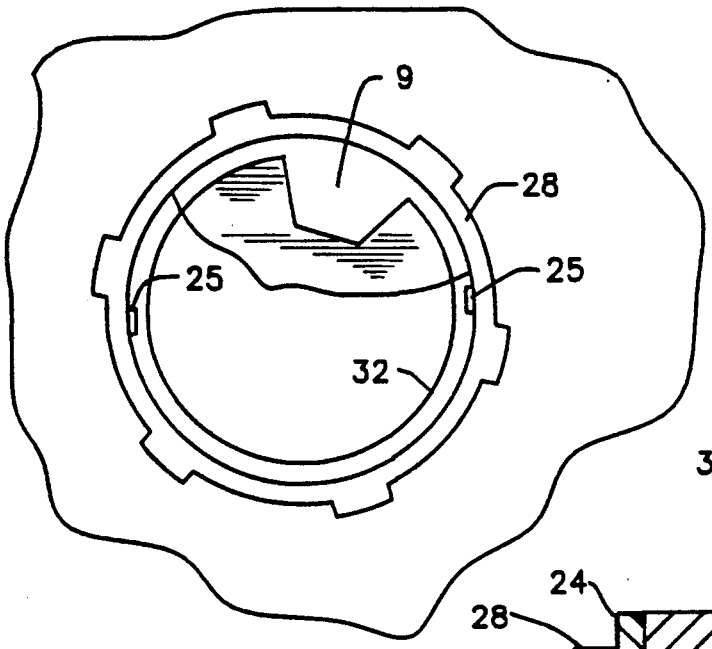
FIG. 4 is a partial plan view taken through line 4—4 of FIG. 3.

The drum (2) is also provided with a flexible liner (16). The flexible liner (16) is seen in FIG. 3 secured to a fitting (18) that attaches to the drum bung hole (8). A flexible liner particularly suitable for the application is manufactured by Scholle Corporation and is preferably single or multiple ply of low density polyethylene and/or nylon film of approximately 2–10 mils thickness. Most preferred at this time is a flexible liner (16) having an inner ply of approximately 4 mils thickness and an outer ply of approximately 4 mils thickness. The characteristics of the flexible liner (16) required for this process are resistance to chemical attack and sufficient toughness to withstand the handling associated with storage and transportation of chemical liquids and treatment and removal of the liner for safe disposal. It is important to the process of this invention that rupture of the flexible line be avoided to insure that any fluid contained within the flexible liner (16) be prevented from escaping into the environment.

The flexible liner (16) is conventionally welded (heat bonded) to a fitting (18) designed to be secured to a conventional drum bung hole (8) in the top head (10). The opening is essentially circular with diametrically opposed locating tabs (9). The fitting (18) best seen in FIGS. 3–7 is comprised of a large diameter flange (20), a smaller diameter flange (22) and a threaded collar (24). The collar (24) has an outside diameter slightly smaller than the opening (8) and has diametrically opposed vertical slots (25) that are sized to receive the tabs (9). The tabs (9) engage the vertical slots (25) to prevent rotation of the fitting (18)and thus the liner (16) within the drum (2). A gasket (26) fits over the collar (24) and rests on the smaller diameter flange (22).

The fitting (18) is secured to the drum top head (10) by a retaining ring (28) that takes the form of a threaded nut. The retaining ring (28) is sized to thread on the outside threads (30) of the collar and is torqued against the drum top head (10) to force the gasket (26) against the inside surface of the drum top head (10). The smaller diameter flange (22) provides the bearing surface for the gasket (26) and thereby prevents the flexible liner section welded to the larger diameter flange (20) from being compressed against the inside surface of the drum top head (10). Practice has shown that a fitting (18) with a collar (24) having an outside diameter of 2.9 inches (74 mm), a large diameter flange (20) of 4.6 inches (117 mm) diameter and 0.04 inches (1 m) thickness, and a smaller diameter flange (22) of 3.2 inches (81 mm) diameter and 0.08 inches (2 mm) thickness provide a fitting (18) that can be safely secured to a drum top head (10) without subjecting the flexible liner (16) to compressive forces from the inside surface of the drum top head (10) that might cause abrasion or wear. The entire fitting (18) is formed of polyethylene.

Figure 5:
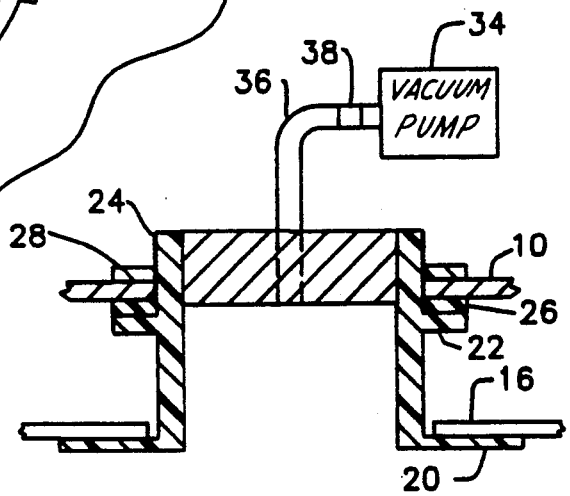
FIG. 5 is a view illustrating the evacuation of the flexible liners within the drum.

The disposal process of the present invention proceeds after the contents of the drum (2) have been removed. If the vent (6) has not been opened during discharge of the contents of the drum (2), it must be opened during the disposal procedure. A vacuum pump (34) seen in FIG. 5, is connected to the fitting (18) by a hose (36) in which a filter (38) of activated carbon is removably inserted. The vacuum pump (34) is run at only a slight vacuum designed only to collapse the flexible liner (16). In practice, a vacuum of about 1.0 to 1.5 psig less than atmospheric is sufficient to collapse the liner bag (16).

Figure 6:
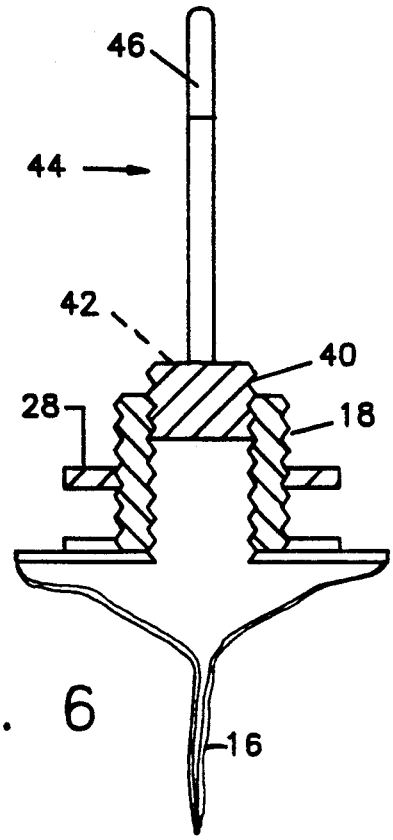
FIG. 6 is a view illustrating the attachment of the plunger to the reseal cap of the flexible bag fitting.
Figure 7:
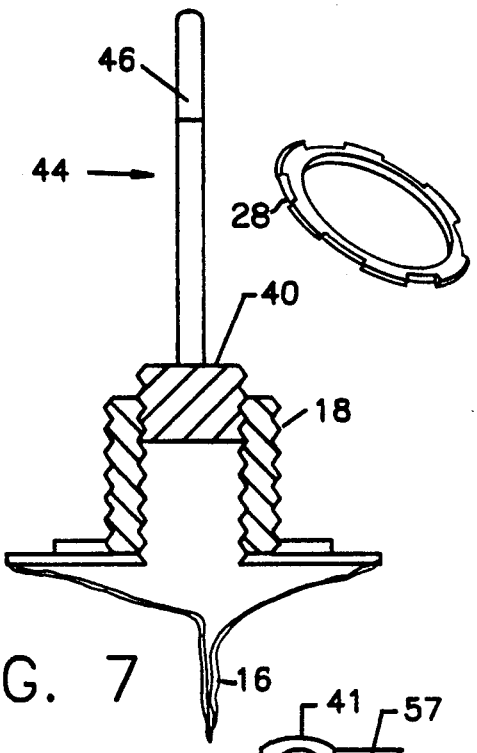
FIG. 7 is a view illustrating the liner fitting with the retaining ring removed.
Figure 11:
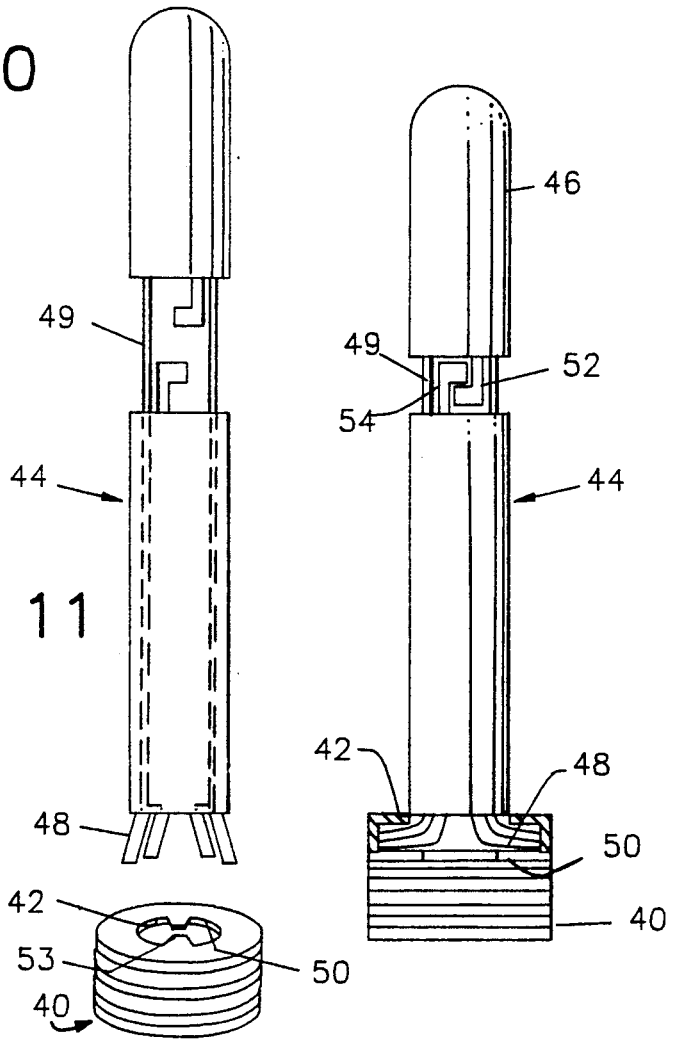
FIG. 11 is an illustration of the plunger of the process.

After collapse of the liner (16), a reseal plug (40) is threaded into the interior threads (32) of the collar (24) of the fitting (18). A conventional TRI-SURE reseal plug is well suited for the application. As seen in FIG. 6, the reseal plug (40) has an essentially circular recess (42) in the upper surface and an essentially circular wall (50) above the recess (42) interrupted only by inward projecting lugs (53) best seen in FIG. 11. After the reseal plug (40) has been secured to the fitting (18), a plunger (44) is attached to the reseal plug (40). The plunger (44) best seen in FIG. 11 is a cylindrical member having a handle (46) and an array of resiliently mounted fingers (48) that can be spread to form a force fit with the circular wall (50) when the fingers (48) are expanded. The plunger (44) is provided with an interior sliding cylinder (49) that can be depressed to force the resilient fingers (48) outwardly or elevated to release the force on the fingers (48).

A catch comprised of a depending lip (52) on the handle (46) and an upwardly extending lip (54) on the plunger body (44) retains the centrally disposed cylinder (49) in a position to force the resiliently mounted fingers (48) against the circular wall (50) of the plug (40) when the handle (46) is rotated to effect engagement of the lips (52) and (54).

With the plunger (44) attached to the reseal plug (40), the retaining ring (28) is removed from the collar (24) and the plunger (44) is used to positively push the fitting (18) and flexible liner (16) to the bottom of the drum (2).

Figure 9A:
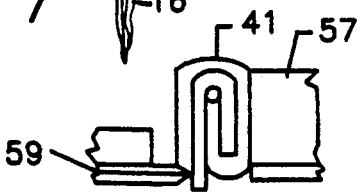
FIG. 9A is a sectional view illustrating removal of the drum lid.
Figure 8:
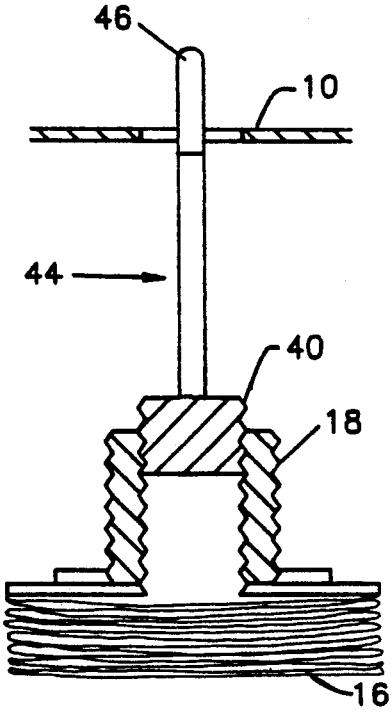
FIG. 8 is a view illustrating positive release of the fitting from the drum.
Figure 9:
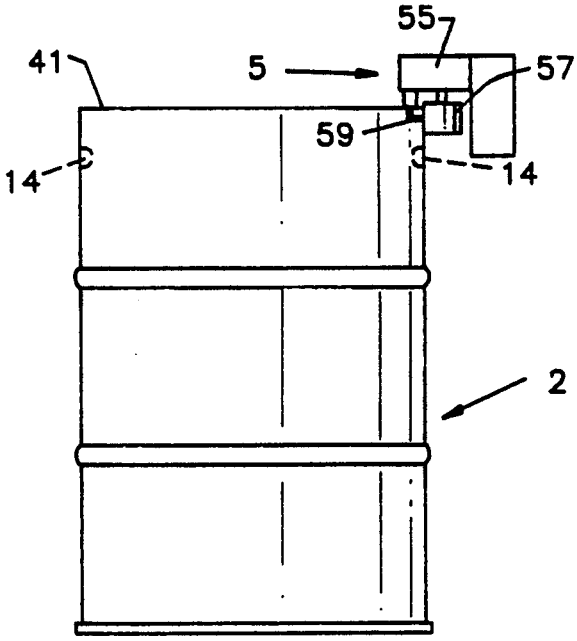
FIG. 9 is a view illustrating removal of the drum lid.

A standard drum head remover (51), as seen in FIGS. 9 and 9A, is then attached to the chime (41) of the drum (2) and engaged to cut the lid (10) from the drum (2). A conventional lid or cover remover (51) is used such as a WIZARD® drum deheader which is comprised of a motor (55), rollers (57) and a cutting blade (59). The protrusions (14) serve to prevent the top head (10) from falling to the bottom of the drum (2) and possibly damaging the liner (16) after the drum top head (10) has been completely cut from drum (2).

Figure 10:
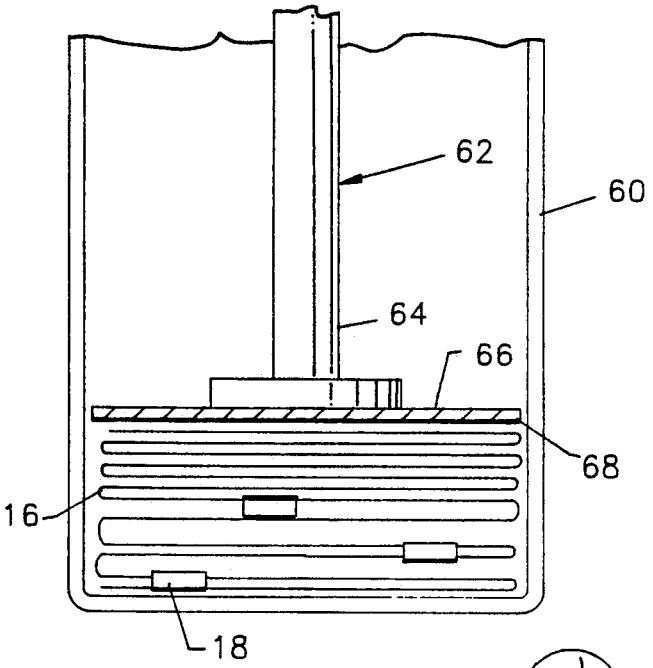
FIG. 10 is a view illustrating compaction of the drum liners of the invention into a disposal drum.

The composite of liner (16) and fitting (18) with the reseal plug or cap (40) is then placed in the disposal drum (60). Compaction of the used liners (16) is employed to enable a large quantity of liners (16) to fit within the disposal drum (60). The disposal drum (60) is formed of polyethylene material that is chemically similar to that used in the liners (16) and is typically a thirty to fifty-seven gallon capacity Act Open Head Drum manufactured by Russell-Stanley Corporation. Compaction, as seen in FIG. 10, can be provided by a compactor (62) having a plunger (64) on which a circular plate (66) is formed. The lower surface (68) of the plate (66) is coated with polytetraflouroethylene or a similar adhesive material to avoid abrading the liners (16) during compaction. It has been found that evacuated liners (16) can be compacted to a density of four to eight pounds per cu. ft. with a compaction force of about five pounds per square inch without damaging the liners (16).

The disposal drum (60) is transported to an incineration site wherein the drum (60) and liners (16) , complete with fittings (18) and reseal plugs (40), are incinerated.

The foregoing patents are incorporated herein by reference. Many obvious variations will suggest themselves to those skilled in the art in light of the above description. All such obvious variations are within the full intended scope of the invention, limited only by the appended claims.

We claim:

1. A process for discarding drum liners comprising the steps of:

a. collapsing the liner within the drum;

b. sealing the collapsed liner;

c. removing the sealed, collapsed liner from the drum; and d. ecologically disposing of the sealed liner.

2. A process as in claim 1 comprising the further step of forming an access opening in the drum after the step of sealing the liner to facilitate removal of the liner from the drum.

3. A process as in claim 2 comprising the further step of positively moving the liner to the bottom of the drum after the liner has been sealed.

4. A process as in claim 3 wherein collapsing the liner within the drum is performed by evacuating the liner under a vacuum.

5. A process as in claim 4 wherein the liner comprises a fitting having an opening to provide communication to the interior of the liner and means to secure the fitting to a conventional drum bung hole, said process further comprising attaching the vacuum hose of a vacuum pump to the fitting opening of the liner and engaging the vacuum pump for evacuating the liner; sealing the liner by closing the fitting opening with a reseal plug; securing a plunger to the reseal plug; removing the means for securing the fitting to the drum bung hole; pushing the fitting and liner to the bottom of the drum and cutting the drum lid from the drum to form an access opening in the drum.

6. A process as in claim 5 wherein the liner is multiply in which the plies are made of low density polyethylene approximately 4 mils thick and the fitting is made of low density polyethylene.

7. A process as in claim 4 comprising the further step of placing the sealed liner in a disposal drum after removal from the drum.

8. A process as in claim 7 wherein the liner is made of low density polyethylene and the disposal drum is made of high density polypropylene.

9. A process as in claim 7 comprising the further step of compacting a plurality of sealed liners into the disposal drum.

10. A process as in claim 9 wherein the step of ecologically disposing of the sealed liner comprises incinerating the disposal drum including the plurality of sealed liners compacted therein.

* * * * *